US008297412B2

(12) United States Patent
Roberts et al.

(10) Patent No.: US 8,297,412 B2
(45) Date of Patent: Oct. 30, 2012

(54) ELEVATOR DISPATCHING CONTROL FOR SWAY MITIGATION

(75) Inventors: Randall Keith Roberts, Hebron, CT (US); Richard K. Pulling, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 318 days.

(21) Appl. No.: 12/811,215

(22) PCT Filed: Mar. 17, 2008

(86) PCT No.: PCT/US2008/057185

§ 371 (c)(1),
(2), (4) Date: Jun. 30, 2010

(87) PCT Pub. No.: WO2009/116986

PCT Pub. Date: Sep. 24, 2009

(65) Prior Publication Data

US 2010/0314202 A1 Dec. 16, 2010

(51) Int. Cl.
*B66B 1/16* (2006.01)

(52) U.S. Cl. ..... 187/388; 187/292; 187/393

(58) Field of Classification Search ..... 187/277, 187/278, 292, 380–388, 391–393
See application file for complete search history.

(56) References Cited

U.S. PATENT DOCUMENTS

| | | | | |
|---|---|---|---|---|
| 5,035,301 | A * | 7/1991 | Skalski | 187/295 |
| 5,861,084 | A * | 1/1999 | Barker et al. | 187/264 |
| 6,164,416 | A * | 12/2000 | Laine et al. | 187/284 |
| 6,234,277 | B1 | 5/2001 | Kaczmarek | |
| 6,488,125 | B1 * | 12/2002 | Otsuka et al. | 187/264 |
| 7,905,329 | B2 * | 3/2011 | Urata | 187/384 |
| 7,909,144 | B2 * | 3/2011 | Fukui et al. | 187/393 |
| 8,123,002 | B2 * | 2/2012 | Smith et al. | 187/393 |
| 2009/0114484 | A1 | 5/2009 | Watanabe et al. | |
| 2010/0065381 | A1 * | 3/2010 | Roberts et al. | 187/401 |
| 2010/0140023 | A1 | 6/2010 | Fukui et al. | |

FOREIGN PATENT DOCUMENTS

| | | | |
|---|---|---|---|
| EP | 1433735 | A1 | 6/2004 |
| JP | 5319720 | A | 12/1993 |
| JP | 2005324890 | A | 11/2005 |
| WO | 2005047724 | A2 | 5/2005 |
| WO | 2007013434 | A1 | 2/2007 |
| WO | 2007067491 | A2 | 6/2007 |
| WO | 2007125781 | A1 | 11/2007 |

OTHER PUBLICATIONS

International Preliminary Report on Patentability for International application No. PCT/US2008/057185 mailed Sep. 30, 2010.
International Search Report and Written Opinion of the International Searching Authority for International application No. PCT/US2008/057185 mailed Mar. 19, 2009.

* cited by examiner

*Primary Examiner* — Anthony Salata
(74) *Attorney, Agent, or Firm* — Carlson, Gaskey & Olds PC

(57) ABSTRACT

An elevator system (20) includes an elongated member (30, 32, 34) that may sway under certain conditions. An exemplary method of controlling the elevator system (20) includes selectively controlling an elevator car dispatching schedule when a condition exists that is conducive to sway of one of the elongated members (30, 32, 34). The control over the elevator car dispatching schedule controls the time that the elevator car is in a predetermined critical zone while the condition exists such that the time does not exceed a selected amount.

20 Claims, 1 Drawing Sheet

ELEVATOR DISPATCHING CONTROL FOR SWAY MITIGATION

BACKGROUND

Many elevator systems include an elevator car and counterweight that are suspended within a hoistway by roping comprising one or more load bearing members. Typically, a plurality of ropes, cables or belts are used for supporting the weight of the elevator car and counterweight and for moving the elevator car to desired positions within the hoistway. The load bearing members are typically routed about several sheaves according to a desired roping arrangement. It is desirable to maintain the load bearing members in an expected orientation based upon the roping configuration.

There are other vertically extending members within many elevator systems. Tie down compensation typically relies upon a chain or roping beneath an elevator car and counterweight. Elevator systems typically also include a traveling cable that provides power and signal communication between components associated with the elevator car and a fixed location relative to the hoistway.

There are conditions where one or more of the vertically extending members such as the load bearing member, tie down compensation member or traveling cable may begin to sway within an elevator hoistway. This is most prominent in high rise buildings where an amount of building sway is typically larger compared to shorter buildings and when the frequency of the building sway is an integer multiple of the natural frequency of a vertically extending member within the hoistway. There are known drawbacks associated with sway conditions.

Various proposals have been made for mitigating or minimizing sway of a vertically extending member within a hoistway. One example approach includes using a swing arm as a mechanical device for inhibiting sway of a load bearing member, for example. U.S. Pat. No. 5,947,232 shows such a device. Another device of this type is shown in U.S. Pat. No. 5,103,937.

Another approach has been to associate a follower car with an elevator car. The follower car is effectively suspended beneath the elevator car and is positioned at the midpoint between the elevator car and a bottom of a hoistway for sway mitigation purposes. A significant drawback associated with this approach is that it introduces additional components and expense into an elevator system. In addition to the follower car and its associated components, the size of the elevator pit must be larger than is otherwise required, which takes up additional real estate space or introduces additional costs or complexities in designing and building the elevator shaft. Additionally, follower cars have only been considered to mitigate sway of compensation ropes and they introduce additional potential complications into an elevator system.

Another approach includes controlling the position of an elevator car and the speed with which the car moves within a hoistway for minimizing the sway. It is known how to identify particular elevator car positions within a hoistway corresponding to particular building sway frequencies that will more effectively excite the vertically extending members. One approach includes minimizing the amount of time an elevator car is allowed to remain at such a so-called critical position when conditions conducive to sway are present. Various elevator movement control strategies are described in WO 2007/013434 and WO 2005/047724.

While the previous approaches have proven useful, those skilled in the art are always striving to make improvements.

SUMMARY

An exemplary method of controlling an elevator system includes selectively controlling an elevator car dispatching schedule when a condition exists that is conducive to sway of an elongated vertical member associated with the elevator car. The dispatching schedule control provides an ability to control a time that the elevator car is in a predetermined critical zone while the condition exists such that the time does not exceed a selected amount.

An exemplary elevator system includes an elevator car. At least one elongated vertical member is associated with the elevator car. A detector detects a condition conducive to sway of the elongated vertical member. A dispatching schedule controller controls a dispatching schedule for the elevator car when the condition exists such that an amount of time the elevator car is in a predetermined critical zone does not exceed a selected amount.

The various features and advantages of the disclosed examples will become apparent to those skilled in the art from the following detailed description. The drawings that accompany the detailed description can be briefly described as follows.

DETAILED DESCRIPTION

Example embodiments of this invention provide sway mitigation within an elevator hoistway to control the amount of sway of one or more elongated vertical members such as a load bearing member (e.g., an elevator rope or belt), a tie down compensation member or a traveling cable, for example. Strategically controlling a dispatching schedule for an elevator car provides enhanced sway mitigation compared to previous approaches.

Figure 1:
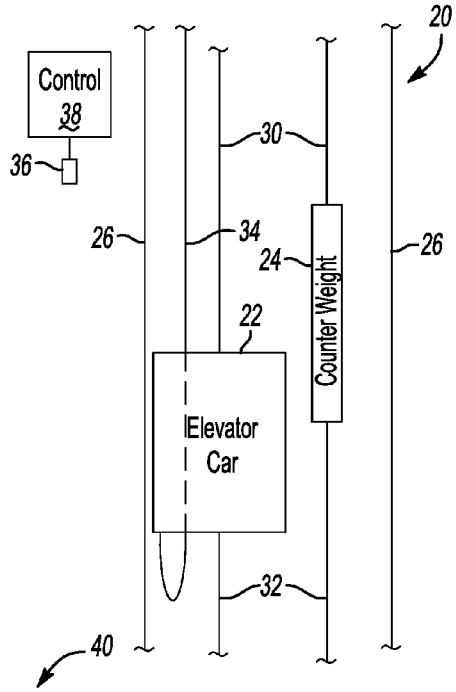
FIG. 1 schematically illustrated selected portions of an elevator system that may incorporate an example embodiment of this invention.

FIG. 1 schematically shows selected portions of an elevator system 20. An elevator car 22 and counterweight 24 are moveable within a hoistway 26 in a known manner. The elevator car 22 and counterweight 24 are supported by a load bearing assembly including roping or belts that support the weight of the elevator car 22 and counterweight 24 and provide for moving them in a known manner. An example load bearing member 30 is shown in FIG. 1. In the illustrated example, a tie down compensation member 32 is associated with the elevator car 22 and the counterweight 24 to provide tie down compensation in a known manner. A traveling cable 34 provides for communicating electrical power and signals between components associated with the elevator car 22 and at least one other device typically located in a fixed position relative to the hoistway 26.

Each of the load bearing member 30, tie down compensation member 32 and traveling cable 34 is an elongated vertical member within the hoistway 26. Any one or more of the elongated vertical members 30, 32, 34 may begin to sway within the hoistway 26 if appropriate conditions conducive to sway exist. Building sway is known to induce sway of an elongated vertical member within a hoistway especially when the frequency of the building sway is an integer multiple of a natural frequency of the elongated member.

The example of FIG. 1 includes a sensor 36 that operates in a known manner to provide an indication of any existing building sway. In one example, the sensor 36 comprises a pendulum-type sensor. Another example includes a wind anemometer. Other example sensors include accelerometers and building tuned mass dampers. A controller 38 communicates with the sensor 36 and determines whether a condition exists that is conducive to sway of at least one of the elongated vertical members within the hoistway 26. The controller 38 is programmed to respond to such a condition by selectively controlling a dispatching schedule for an elevator car.

Figure 2:
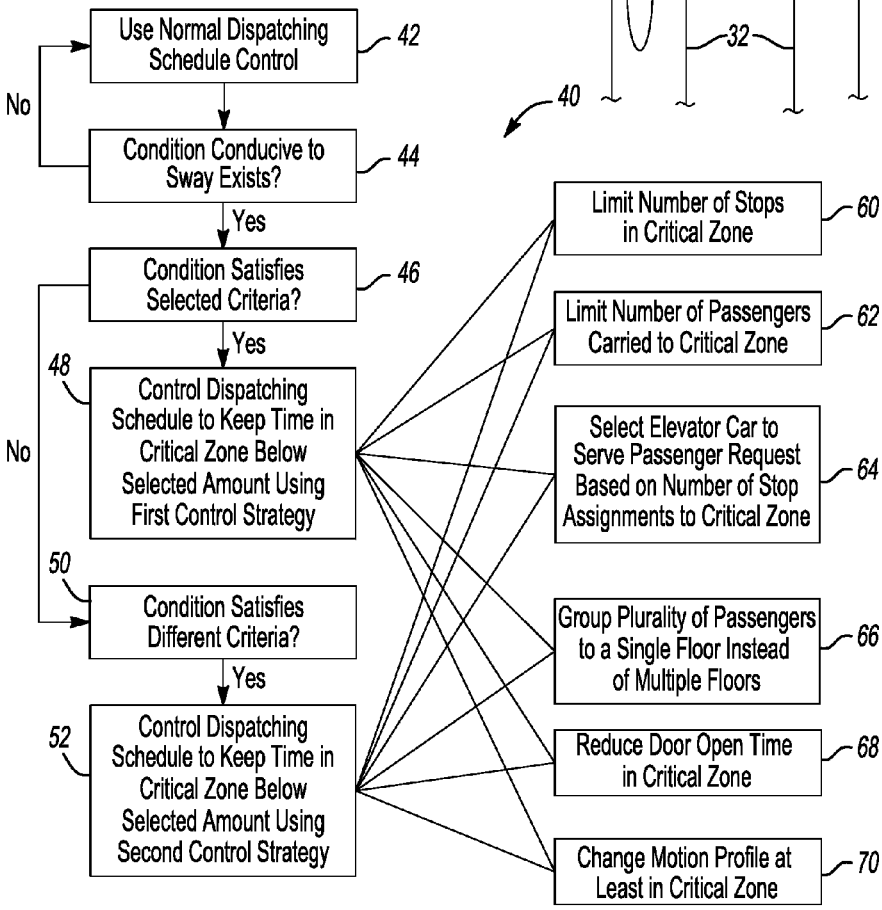
FIG. 2 schematically illustrates an example approach of sway mitigation designed according to an example embodiment of this invention.

FIG. 2 includes a flowchart diagram 40 that summarizes an example approach. The controller 38 uses a normal dispatching schedule control at 42. An elevator system will have a normal dispatching schedule control algorithm that dictates how one or more elevator cars in the system respond to passenger requests for service. In one example, the controller 38 operates based on a destination entry approach where passengers enter requests for service outside of elevator cars. In another example, the controller 38 operates based upon passenger requests made from within a car using a car operating panel, for example.

At 44, a decision is made whether a condition conducive to sway exists. This is accomplished in the example of FIG. 1 by the controller 38 determining whether an indication provided by the sensor 36 indicates that sway of one or more elongated vertical members is likely. If not, the process in FIG. 2 continues at 42 using the normal dispatching schedule control. If a condition conducive to sway does exist, then a different dispatching schedule control is implemented.

In the example of FIG. 2, two different dispatching schedule control strategies are used for different sway conditions. The example of FIG. 2 includes a decision at 46 whether the condition that is conducive to sway satisfies a selected criteria. If so, the dispatching schedule is controlled at 48 to keep a time that the elevator car 22 is in a predetermined critical zone below a selected amount using a first control strategy. If the criteria at 46 are not satisfied, a determination is made at 50 whether the sway-conducive condition satisfies different criteria (e.g., is more severe). If so, the dispatching schedule is controlled at 52 using a second control strategy. The different control strategies allow for different parameters and control values to be used for different types of conditions that are conductive to sway. For example, a condition that is conducive to a relatively small amount of sway may allow for longer times during which an elevator car can remain in a critical zone. A condition that is conducive to more severe sway, on the other hand, may require a more restrictive amount of time or no time for an elevator car to remain in a critical zone. Depending on the criteria that describes different conditions conducive to sway, the example of FIG. 2 allows for selecting different specialized control strategies to control the dispatching schedule for an elevator car or a group of elevator cars.

Selectively controlling the dispatching schedule for the elevator car facilitates minimizing sway or the effects of sway. One aspect of the example dispatching schedule controls is keeping the amount of time that an elevator car spends in a critical zone below a desired amount based upon the current conditions conducive to sway.

The example of FIG. 2 includes a plurality of different control techniques that may be part of the first control strategy, or the second control strategy or both. One way in which the illustrated example controls the dispatching schedule is to limit the number of stops that an elevator car makes within the critical zone at 60. For example, the first control strategy used at 48 may allow for a selected number of stops within a critical zone. The second control strategy used at 52 may allow for a lesser number of stops in the critical zone while a condition conducive to sway exists. Limiting the number of stops in a critical zone has an effect on the amount of time that an elevator car spends in a critical zone. It is possible in some examples to limit the number of stops in a critical zone to prevent any stops from occurring in the critical zone during a particular condition that is conducive to a certain amount of sway.

At 62, another control feature includes limiting the number of passengers carried to the critical zone. It may be possible for example, to allow for five passengers to be carried to the critical zone. The selection of the allowable number may depend on average passenger weight, dwell times at a stop, how dwell times are controlled based upon the number of passengers, or a combination of such factors. Given a particular elevator system configuration and this description, those skilled in the art will be able to determine how best to control the number of passengers that may be carried to a critical zone to meet the needs of their particular situation for mitigating sway by controlling the amount of time that an elevator car spends in a critical zone.

At 64, an elevator car selection is made to serve a passenger request based upon the number of stop assignments that elevator car has in the critical zone. For example, the controller 38 may be responsible for controlling how passengers are assigned to elevator cars where a plurality of possible cars are available. The feature shown at 64 includes selecting an elevator car based upon how many stops that elevator car has in a critical zone. If one elevator car already has one stop in a critical zone, one example includes selecting a different elevator car that does not have any stops currently assigned for the critical zone. Such a technique allows for minimizing the time that each of the example elevator cars remains in the critical zone. In another example, it may be desirable to keep one of the elevator cars entirely out of the critical zone because of particular characteristics of an elevator system. In such an example, the control strategy may include a bias to always assign a different elevator car to a stop in a critical zone.

At 66, the example of FIG. 2 includes grouping a plurality of passengers to a single floor instead of taking them to multiple floors. This feature is useful, for example, to minimize the number of stops in a critical zone. Assuming five passengers have made requests for service to several different floors, each of which is in the critical zone, this feature includes grouping at least some of those passengers so that they are all carried to a single floor instead of the different floors associated with their respective requests. For example, a single floor within the critical zone may be designated to carry all passengers requiring service to the critical zone while the condition that is conducive to sway exists. Some indication (e.g., visible or audible) is provided to such passengers indicating to them that they will be carried to a particular floor at which they should exit the elevator car. The floor to which such passengers will be carried may be selected based upon an ability of the passenger to transfer to another elevator car at that floor or to access a stairway for purposes of eventually arriving at their desired floor location.

In one example, any passengers requesting service to a floor in a critical zone will be carried to a designated floor adjacent to but outside of the critical zone. Such a floor is selected based upon an ability of such passengers to access another elevator car from that floor or to use a stairway, for example, to eventually arrive at their intended floor destination.

Grouping passengers and carrying them to a single floor rather than making stops at multiple floors within a critical zone is useful for minimizing the number of stops an elevator car makes in a critical zone and is useful for minimizing an amount of time that an elevator car remains in a critical zone.

At 68, the amount of door open time for an elevator car within a critical zone is reduced. A normal scheduling control strategy allows for a certain amount of time during which doors remain open while an elevator car is stopped at a landing. The feature shown at 68 includes reducing the amount of time the doors are left open, which allows for reducing the amount of time that an elevator car has to remain at a stop in a critical zone. This feature may also be useful in connection with limiting the number of passengers carried to a critical zone as schematically shown at 62 because allowing fewer passengers to exit or enter an elevator car while in a critical zone allows for reducing door open times, for example.

Another feature is shown at 70 which includes changing a motion profile at least in the critical zone. Elevator cars typically have motion profiles that control such things as acceleration, deceleration, dwell times and jerk. When an elevator car has to travel to a critical zone during a condition that is conducive to sway, this feature includes changing the motion profile by altering an amount of acceleration, deceleration, jerk or a combination of two or more of these. A passenger may be willing to accept an increased sense of acceleration or deceleration, for example, in order to be taken to a desired stop in a critical zone compared to having to walk up several floors of stairs when the car would otherwise not be allowed to travel to the critical zone. Of course, there are code limitations on acceptable amounts of acceleration, deceleration and jerk and one example implementation includes increasing the amount of one of those to be as close as possible to the acceptable limit for purposes of limiting an amount of time that the elevator car remains in a critical zone.

Any one or combination of the features schematically shown at 60-70 may be included as part of the first control strategy or the second control strategy in the example of FIG. 2. Given that different condition criteria instigate the use of the first or second control strategy, the parameters defining the features 60-70 may be different in the two different control strategies or one or more of them may be the same, depending on the needs of a particular situation. Given this description and the particulars of a building and an elevator system, those skilled in the art will be able to select which of the features 60-70 are desired and to customize the parameters used for them.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system, comprising selectively controlling an elevator car dispatching schedule when a condition exists that is conducive to sway of an elongated vertical member associated with the elevator car to control a time that the elevator car is in a predetermined critical zone while the condition exists such that the time does not exceed a selected amount.

2. The method of claim 1, comprising using a first scheduling control strategy;

determining when the condition exists; and switching to a second, different scheduling control strategy responsive to determining that the condition exists, the second control strategy including preventing the time from exceeding the selected amount.

3. The method of claim 2, comprising using the second control strategy when the condition satisfies a selected criteria; and switching to a third, different control strategy when the condition satisfies a different criteria, the third control strategy including a different selected amount of time that the elevator car is permitted in the critical zone.

4. The method of claim 1, comprising determining whether a passenger request for service requires the elevator car to stop in the critical zone;

denying the passenger request if the elevator car will be in the critical zone more than the selected amount if the elevator car provides the requested service; and accepting the passenger request if the elevator car will be able to provide the requested service without exceeding the selected amount of time in the critical zone.

5. The method of claim 4, comprising providing an indication to the passenger if the request for service is denied, the indication comprising at least one of an audible indication or a visible indication through at least one of a destination entry device outside of the elevator car or a car operating panel in the elevator car.

6. The method of claim 4, comprising prompting the passenger to select an alternate floor if the request for service is denied.

7. The method of claim 1, comprising limiting a number of stops at floors within the critical zone so that the number of stops does not exceed a selected number.

8. The method of claim 1, comprising controlling the time the elevator car is in the critical zone by changing a motion profile of the elevator car at least while the elevator car is in the critical zone.

9. The method of claim 1, comprising controlling a number of passengers that are serviced within the critical zone.

10. The method of claim 1, comprising grouping a plurality of passengers desiring service to a plurality of floors within the critical zone and scheduling the entire plurality of passengers to be carried to a single floor.

11. The method of claim 10, wherein the single floor is in the critical zone.

12. The method of claim 10, wherein the single floor is adjacent to but outside of the critical zone.

13. The method of claim 1, comprising controlling the time the elevator car is in the critical zone by reducing an amount of time that a door of the elevator car remains open while in the critical zone.

14. The method of claim 1, comprising assigning a passenger service request to one of a plurality of elevator cars based on number of scheduled stops for each of the elevator cars in a corresponding critical zone.

15. An elevator system, comprising:

an elevator car;

an elongated vertical member associated with the elevator car;

a detector for detecting a condition conducive to sway of the elongated vertical member; and a dispatching schedule controller that controls a dispatching schedule for the elevator car when the condition exists such that an amount of time the elevator car is in a predetermined critical zone does not exceed a selected amount.

16. The elevator system of claim 15, wherein the dispatching schedule controller uses a first scheduling control strategy when the condition does not exist and switches to a second, different scheduling control strategy responsive to the condition existing, the second control strategy including preventing the time from exceeding the selected amount.

17. The elevator system of claim 16, wherein the dispatching schedule controller uses the second control strategy when the condition satisfies a selected criteria and uses a third, different control strategy when the condition satisfies a different criteria, the third control strategy including a different selected amount of time that the elevator car is permitted in the critical zone.

18. The elevator system of claim 15, wherein the dispatching schedule controller determines whether a passenger request for service requires the elevator car to stop in the critical zone, denies the passenger request if the elevator car will be in the critical zone more than the selected amount if the elevator car provides the requested service and accepts the passenger request if the elevator car will be able to provide the requested service without exceeding the selected amount of time in the critical zone.

19. The elevator system of claim 18, wherein the dispatching schedule controller provides an indication to a passenger if the request for service is denied, the indication comprising at least one of an audible indication or a visible indication through at least one of a destination entry device outside of the elevator car or a car operating panel in the elevator car.

20. The elevator system of claim 15, wherein the dispatching schedule controller assigns a passenger service request to one of a plurality of elevator cars based on a number of scheduled stops for each of the elevator cars in a corresponding critical zone.

* * * * *